US010151123B2

(12) United States Patent
Ke et al.

(10) Patent No.: US 10,151,123 B2
(45) Date of Patent: Dec. 11, 2018

(54) LOCK ARRANGED ON SUITCASE CAPABLE OF BEING OPENED OR CLOSED WITHOUT USING ZIPPER, AND TRAVEL SUITCASE

(71) Applicant: SHANGHAI DAMAO-SHINE TECHNICAL CO., LTD, Shanghai (CN)

(72) Inventors: Huizi Ke, Shanghai (CN); Xiuxing Lai, Shanghai (CN)

(73) Assignee: SHANGHAI DAMAO-SHINE TECHNICAL CO., LTD., Jiading District, Shanghai (CN)

( * ) Notice: Subject to any disclaimer, the term of this patent is extended or adjusted under 35 U.S.C. 154(b) by 0 days.

(21) Appl. No.: 15/507,106

(22) PCT Filed: Aug. 3, 2015

(86) PCT No.: PCT/CN2015/085919

§ 371 (c)(1),
(2) Date: Feb. 27, 2017

(87) PCT Pub. No.: WO2016/029780

PCT Pub. Date: Mar. 3, 2016

(65) Prior Publication Data

US 2017/0275924 A1 Sep. 28, 2017

(30) Foreign Application Priority Data

Aug. 29, 2014 (CN) ..... 2014 2 0493265 U

(51) Int. Cl.
*A45C 5/02* (2006.01)
*E05B 63/00* (2006.01)
(Continued)

(52) U.S. Cl.
CPC ..... *E05B 63/0052* (2013.01); *A45C 5/02* (2013.01); *E05B 13/002* (2013.01);
(Continued)

(58) Field of Classification Search
CPC . A45C 13/1084; A45C 13/126; A45C 13/103; A45C 5/02
(Continued)

(56) References Cited

U.S. PATENT DOCUMENTS 4,395,892 A * 8/1983 Remington ..... E05B 37/02 190/28
5,237,842 A * 8/1993 Rasch ..... E05B 37/0034 70/285
(Continued)

FOREIGN PATENT DOCUMENTS

CN 201771291 U 3/2011
CN 202106831 U 1/2012
(Continued)

*Primary Examiner* — Sue A Weaver
(74) *Attorney, Agent, or Firm* — Muncy, Geissler, Olds & Lowe, P.C.

(57) ABSTRACT

This invention discloses a lock that set on a suitcase of being opened or closed without using a zipper, which including an operating component and a locking component that are separately-mounted; the operating component is set on a non-border position of the suitcase, and the locking component is set on the border of the suitcase, wherein the locking component comprises at least one locking unit, the force transfer between the operating component and the locking component is provided by a force transmission mechanism that connected between the operating component and the locking component; the operating component comprises an operation member, and the locking unit comprises a lock head and a lock hook, wherein driving the operation member can drive the lock head or the lock hook to move through the force transmission mechanism, to lock or unlock the lock. This invention also provides a suitcase provided with the lock as described above. This invention set the operating component and the locking component separately, which solves the problem that the lock can only
(Continued)

be installed on the border of the suitcase, and only the locking component needs to be installed on the border of the suitcase, while the operating component can be installed at any position of the suitcase other than the border.

25 Claims, 18 Drawing Sheets

(51) Int. Cl.

| | |
|---|---|
| ***E05B 65/52*** | (2006.01) |
| ***E05B 63/24*** | (2006.01) |
| ***E05B 53/00*** | (2006.01) |
| ***E05C 9/00*** | (2006.01) |
| ***E05B 13/00*** | (2006.01) |
| *E05B 55/12* | (2006.01) |
| *E05B 63/20* | (2006.01) |

(52) U.S. Cl.
CPC ..... *E05B 53/005* (2013.01); *E05B 63/248* (2013.01); *E05B 65/52* (2013.01); *E05B 65/5238* (2013.01); *E05C 9/00* (2013.01); *E05B 55/12* (2013.01); *E05B 63/20* (2013.01)

(58) Field of Classification Search
USPC ..... 190/191, 119, 101; 70/69; 292/DIG. 48
See application file for complete search history.

(56) References Cited

U.S. PATENT DOCUMENTS

| | | | | |
|---|---|---|---|---|
| 5,479,836 A | | 1/1996 | Chang | |
| 6,006,558 A | * | 12/1999 | Peters | A45C 1/00 109/53 |

FOREIGN PATENT DOCUMENTS

| | | |
|---|---|---|
| CN | 204060213 U | 12/2014 |
| CN | 104265089 A | 1/2015 |
| CN | 204098640 U | 1/2015 |

* cited by examiner

LOCK ARRANGED ON SUITCASE CAPABLE OF BEING OPENED OR CLOSED WITHOUT USING ZIPPER, AND TRAVEL SUITCASE

TECHNICAL FIELD

This invention relates to a technical field of suitcase designing, especially relates to a lock arranged on suitcase capable of being opened or closed without using zipper, and travel suitcase.

BACKGROUND TECHNOLOGY

Suitcase is well received by people because it can store a variety of items in people's daily lives, but the lock of some suitcases with the border in the middle such as aluminum-bordor suitcase is usually set in the aluminum frame, which structure is single. At the same time, the lock installed in the outer side of suitcase, which is easily get damage when suitcase collision occurs in transport.

DESCRIPTION OF THE INVENTION

To solve the above problem, this invention provides a lock set on a suitcase of being opened or closed without using a zipper, the lock comprises: an operating component and a locking component, which are mounted separately, the operating component is set on a non-border of the suitcase, the locking component is set on the border of the suitcase, and the locking component comprises at least one locking unit, the force transfer between the operating component and the locking component is provided by a force transmission mechanism which is connected between the operating component and the locking component; the operating component comprises an operation member; the locking unit comprises a lock head and a lock hook, locking or unlocking the lock can be realized by driving the operation member to moving the lock head or the lock hook through the force transmission mechanism.

Preferably, the operation member further comprises a lock body mechanism, the lock body mechanism comprises a lock body and a rotating component or a moving component that is set in the lock body, the operating member and the force transmitting mechanism are both connected to the rotating component or the moving component, the operating member drives the rotating component to rotate or drive the moving component to move, and the rotating component rotates or the moving component moves to drive the lock head or the lock hook to move through the force transmission mechanism.

Preferably, the lock head is installed on the border of the suitcase case cover through a lock bracket, the force transmission mechanism drives the lock head to move along the lock bracket; the lock hook is installed on the border of the other case cover of the suitcase, and opposite to the lock head, the lock head moving along the lock bracket can realize buckling or separating of the lock head and the lock hook.

Preferably, the locking component comprises two locking units, the lock heads of the two locking units are connected to the force transmission mechanism in series, and the movement directions of the lock heads of the two locking units are consistent, and the hook parts of the lock hooks of the two locking units toward the same direction.

Preferably, the locking component comprises a first locking unit and a second locking unit, the first locking unit comprises a first lock head and a first lock hook and the second locking unit comprises a second lock head and a second lock hook;

wherein, the force transmitting mechanism drives the first lock head to move, the second lock head is connected to the first lock head through a steering mechanism, the direction of movement of the first lock head and the second lock head is opposite, and the hook parts of the first lock hook and the second lock hook toward the opposite.

Preferably, the steering mechanism comprises a rotary table, a first connecting rod and a second connecting rod, the first lock head is connected to the rotary table through the first connecting rod; one end of the second connecting rod is connected to the rotary table, the other end of the second connecting rod is connected to the second lock head, and the first connecting rod is parallel to the second connecting rod; when the first lock head moves towards one side and separates itself from the first lock hook, the first connecting rod drives the rotary table to rotate, and the rotary table rotates to drive the second connecting rod to move towards the other side, and the second connecting rod drives the second lock head to move towards the other side to achieve separation with the second lock hook.

Preferably, the operating component further includes an open-close locking mechanism for controlling the movement or locking of the rotating component or the moving component.

Preferably, the operating component further includes a self-locking mechanism for self lock of the operating member.

Preferably, the force transmitting mechanism adopts a wire drawing mechanism or a rope pulling mechanism a.

Preferably, the rotating component is a rotating shaft, the operating member and the force transmitting mechanism are both connected with the rotating shaft, the operating member drives the rotating shaft to rotate, the rotating shaft rotates to drive the lock head and the lock hook to move relatively through the force transmission mechanism;

the moving component includes a cover plate, a movable block that arranged on the cover plate, the locking block which is connected with the movable block through a eccentric column, the operating member is connected with the locking block and drives the locking block to rotate, the locking block rotates to drive the movable block to move through the eccentric column, the movable block drives the lock head and the lock hook to move relatively through the force transmission mechanism.

Preferably, the operating member is a toggle or a handle.

This invention also provide with a lock set on a suitcase of being opened or closed without using a zipper, including a lock body, a toggle, a locking rope, a rotating shaft, a lock head and a lock hook, wherein, the rotating shaft is set in the lock body, the side of the rotating shaft is respectively connected with the two ends of the locking rope, the two connecting parts of the rotary shaft and the locking rope are located in the same radial direction of the rotating shaft position; the toggle is connected to the rotating shaft, and drives the rotating shaft to rotate; the locking rope is connected with the lock head, the fastening surface of the lock head and the lock hook is parallel to the locking rope.

Preferably, two parallel guiding grooves are set in the circumferential direction of the rotary shaft, and the two ends of the locking rope are respectively set in two guiding grooves, and the guiding groove guides the locking rope.

Preferably, the lock further includes a self-locking mechanism which is used for locking the toggle and the lock body.

Preferably, the lock body, a handle and the rotating shaft are installed at the upper corner of the front surface of the suitcase in a sunken way, the rotating surface of the toggle is perpendicular to the plane where the lock hook and lock head is located.

Preferably, the toggle has a limiting structure which is used for defining a maximum rotation angle of the toggle as 120 degree.

Preferably, external of the locking rope is further sleeved with a rope locking thimble.

Preferably, the number of the lock heads and the number of the lock hooks are 2-3.

This invention also provided with a lock set on a suitcase of being opened or closed without using a zipper, including a cover and a bottom shell, the cover and the bottom shell are fixedly connected, and the cover and the bottom shell cooperate to form an accommodating space, wherein the accommodating space is provided with a cover plate, a locking plate movably connected with the cover plate, a wire drawing mechanism and an open-close locking mechanism for driving the movement of the locking plate, the locking plate includes a first hook part, a moving part and a connecting part, the moving part is located between the first hook part and the connecting part, the first hook part of the locking plate are fixedly connected with open-close locking mechanism, the connecting part of the locking plate is fixedly connected with the wire drawing mechanism, the wire drawing mechanism comprises a movable block that movably connected with the cover plate, the bottom of the movable block is provided with a first clamping slot, and the first clamping slot is internally provided with a steel wire, and further comprises at least one locking unit for controlling the opening and closing of the suitcase, the wire drawing mechanism is driven-connected with a locking component through a steel wire.

Preferably, a chute for moving the movable block is set in the cover plate.

Preferably, the lock further comprises a locking block located in the accommodating space and a handle located outside the accommodating space, a first eccentric column is set at the bottom of the locking block, a first clamping groove which is clamped with the first eccentric column is formed in the top of the movable block; the locking block is further provided with a second clamping groove which is clamped with the connecting part of the locking plate;

a first positioning column is set at the bottom of the handle, a positioning hole is formed in the top of the locking block, the first positioning column penetrates through the cover and connects with the positioning hole fixedly;

the handle is rotated to drive the locking block to rotate, and the locking block rotating drives the movable block to move through the first eccentric column.

Preferably, a self-locking mechanism is set between the handle and the cover plate, the self-locking mechanism comprises a pushing block and a top block set perpendicularly to each other, the pushing block comprises a push button part and an abutting part, the top block comprises a protruding part and a first fixed part;

a first accommodating groove is formed in the bottom of the handle, the abutting part and the protruding part are all located in the first accommodating groove, and the abutting part abuts against the protruding part;

a second positioning column is set on the first fixed part, a third positioning column is set on the cover plate, the third positioning column is positioned right below the second positioning column, a spring is sleeved between the second positioning column and the third positioning column.

Preferably, the open-close locking mechanism comprises a lock core, a lock core sleeve that sleeved on the lock core, and a rotating block that set at the bottom of the lock core sleeve;

the cover plate is provided with a second accommodating groove for accommodating the rotating block, a positioning groove is set at the bottom of the lock core, a fourth positioning column that fixedly connected with the positioning groove is set on the top of the rotating block; a second eccentric column is set at the bottom of the rotating block; the second eccentric column and the first hook part of the locking plate is clamped with each other.

Preferably, the locking component includes:

a lock bracket, set on the suitcase, and a third accommodating groove is formed in the lock bracket;

a lock head, set in the third accommodating groove and can move along the accommodating groove; and a second hook part is set on one side of the lock head, and a second clamping slot used for arranging the steel wire is set on the other side of the lock head;

a lock hook, comprising a third hook part clamped with the second hook part, and a second fixed part used for fixing the lock hook to the suitcase.

Preferably, the rest part of the steel wire is provided with a rubber sleeve except the part being set in the first clamping slot and the second clamping slot.

This invention also provided with a suitcase, the suitcase is provided with a border connecting part, the suitcase is provided with a lock, the lock comprises an operating component and a locking component, the operating component and the locking component are connected and transmit the force through a force transmission mechanism, the locking component is provided inside the suitcase border, and the operating component is concavely formed in the outer surface of the suitcase except the border of the suitcase.

Preferably, the operation component is set on one of the front side, the right side and the upper surface of the suitcase.

Preferably, the operating component is set at an edge or a middle portion of a surface of the suitcase.

Preferably, the shape of the operating component is a shape that is convenient for manual opening type.

Preferably, the shape of the operation component is strip-shaped, round, star-shaped, plum-blossom-shaped, square or rectangular.

Preferably, a structure that is convenient to open manually is set on the operating component.

Preferably, a lock core is further integrated on the operation component.

Preferably, the operation component is a spring-loaded structure.

Preferably, the operating component opens the locking component by rotating or pulling and toggling.

Preferably, the lock is any one of abovementioned.

Compared with the present technique, the invention has the following advantages:

the invention provides a lock arranged on suitcase capable of being opened or closed without using zipper, and travel suitcase, the lock includes an operating component and a locking component which are separately mounted, and the operating component and the locking component are connected by a force transmission device, the operating component is set on non-frame part, the locking component is set on the frame of the suitcase; With the abovementioned arrangement, the invention makes the lock operation component of the suitcase out of the border, and turns the setting position of the lock diversified, the invention solves the problem that the position of the lock set is single in the present technique, simplifies the structure of the lock, and provides a new suitcase structure.

DESCRIPTION OF SYMBOLS

| | |
|---|---|
| 1-an operating component | 11-a handle/toggle |
| 1101-a first positioning column | 1102-a first accommodating groove |
| 12-a lock body mechanism | 1201-a cover |
| 1202-a bottom shell | 13-a rotating shaft |
| 14-a cover plate | 1401-a third positioning column |
| 15-a locking plate | 1501-a first hook part |
| 1502-a moving part | 1503-a connecting part |
| 16-a locking block | 1601-a first eccentric column |
| 1602-a positioning hole | 1603-a second clamping groove |
| 2-a locking component | 21-a lock bracket |
| 2101-a third accommodating groove | 2202-a second lock head |
| 2203-a second hook part | 2204-a second clamping slot |
| 23-a lock hook | 2301-a first lock hook |
| 2302-a second lock hook | 2303-a third hook part |
| 2304-a second fixed part | 3-a force transmission mechanism |
| 31-a steel wire/locking rope | 32-a movable block |
| 3201-a first clamping slot | 3202-a first clamping groove |
| 4-a steering mechanism | 41-a rotary table |
| 4101-a second connecting rod mounting hole | |
| 4102-a first connecting rod mounting hole | |
| 4103-a shaft | 42-a first connecting rod |
| 43-a second connecting rod | 51-a pushing block |
| 5101-a push button part | 5102-an abutting part |
| 52-a top block | 5201-a protruding part |
| 5202- a fixed part | 5203-a second positioning column |
| 53-a spring | 61-a lock core |
| 6101-a positioning groove | 62-a lock core sleeve |
| 63-a rotating block | 6301-a fourth positioning column |
| 6302-a second eccentric column | 7-a suitcase |
| 701-a border | |

DETAILED DESCRIPTION OF EXAMPLE EMBODIMENTS

Further description of this invention is provided combining with the figures and specific embodiments in the following. The following examples are given by way of illustration only and are not intended to limit the scope of the invention.

Figure 1:
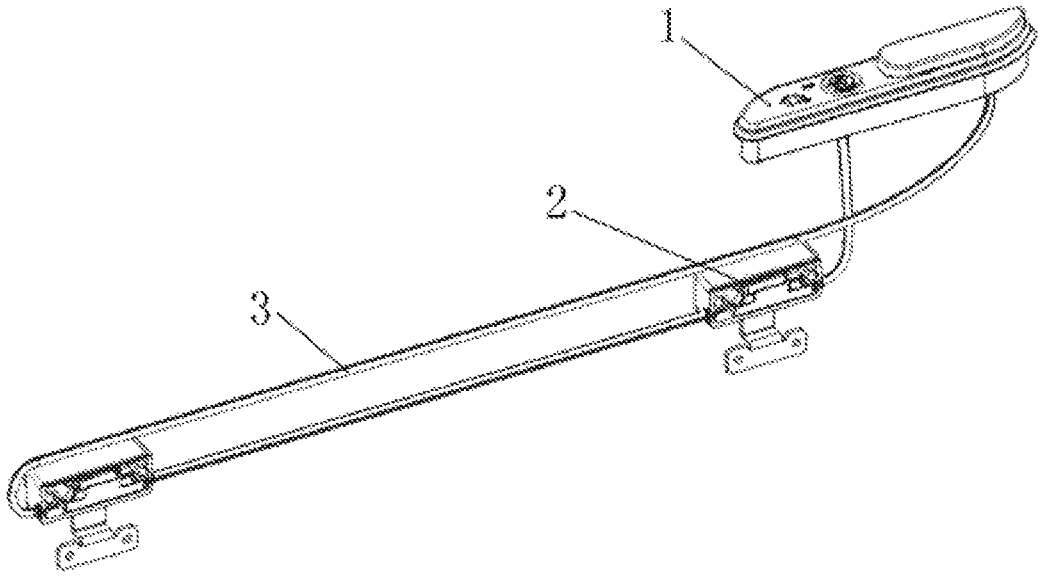
FIG. 1 is a schematic diagram 1 of the overall structure of the lock provided by the invention.
Figure 2:
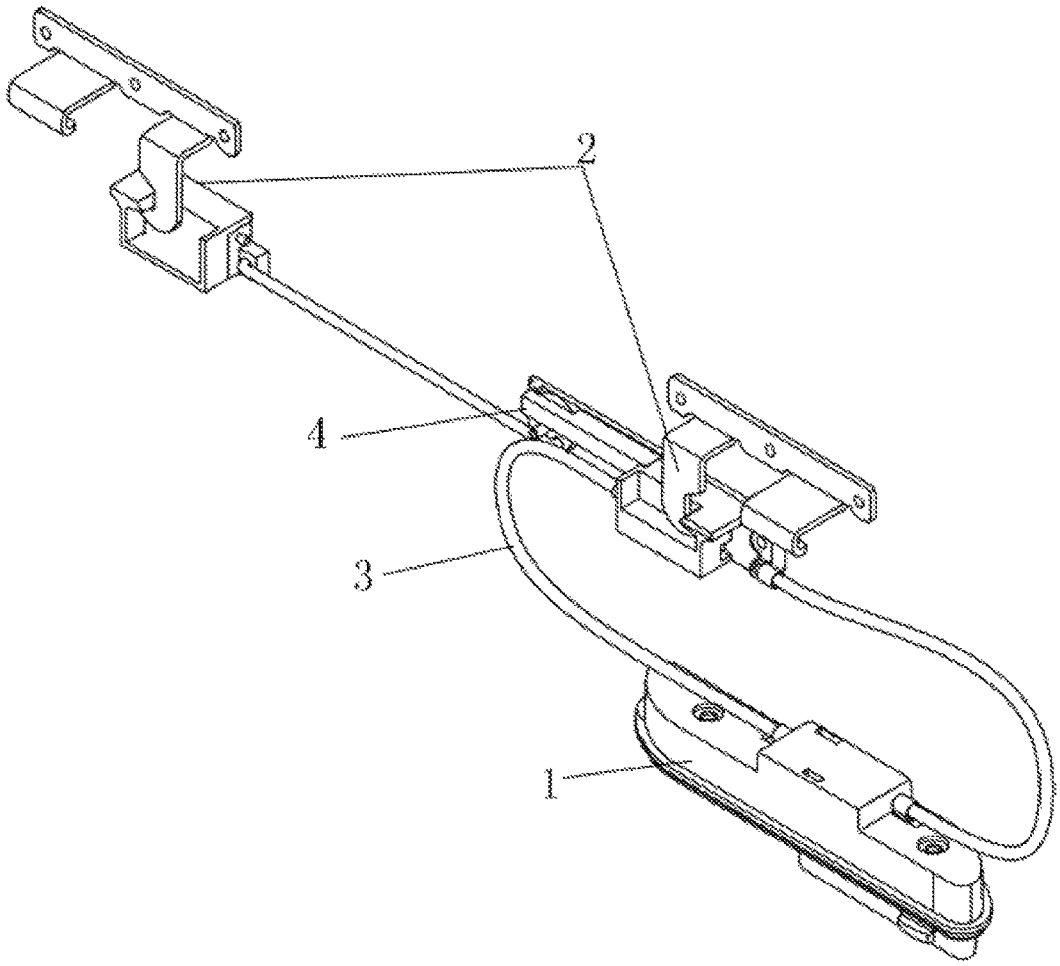
FIG. 2 is a schematic diagram 2 of the overall structure of the lock provided by the invention.

Please refer to FIG. 1 to FIG. 2, this invention provides a lock set on a suitcase of being opened or closed without using a zipper, including an operating component 1 and a locking component, the locking component comprises at least one locking unit 2, the operation component 1 transfer the force through a force transmission mechanism 3 to the locking component to realize the locking or unlocking of the locking part.

Figure 3:
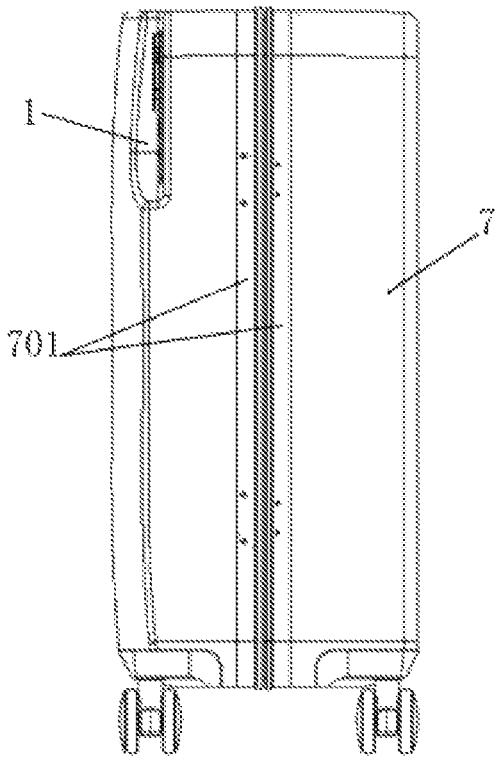
FIG. 3 is a schematic diagram of the structure of the lock which provided by the invention being installed on the suitcase.

As shown in FIG. 3, a suitcase of being opened or closed without using a zipper is usually composed of two covers, respectively a upper cover and a lower cover, edges of the upper cover and the lower cover are provided with a border 701 that has the function of strengthening and supporting, the border 701 may be formed integrally with the upper cover or the lower cover, or may be provided separately, and the border 701 may be an aluminum border or a rigid border and so on; the invention sets the operating component 1 and the locking component of a lock separately; the operating component 1 is set on a non-border part of the suitcase, the locking component is set on the border 701 of the suitcase; this invention solves the problem that the lock can only be installed on the border of the suitcase, and the present invention only needs to install the locking component on the border of the suitcase, and the operating component 1 can be installed at any position other than the border.

Wherein, the operating component comprises a lock body mechanism and an operation member, the operating member can be a toggle or a handle or other structures; the lock body mechanism further comprises a lock body, a rotating component or a moving component set in the lock body, the rotating component or the moving component is arranged on the arbitrary position of the suitcase through the lock body; the operating member is connected to the rotating component or the moving component, the operating member drives the rotating component to rotate or drive the moving component to move. Wherein, the rotating component can be a rotary shaft, the operating member drives the rotary shaft, the rotary shaft is connected to the force transmitting mechanism 3, and the locking component is locked or unlocked through the force transmitting mechanism 3; the moving component can includes a cover plate, a movable block that arranged on the cover plate, the locking block which is connected with the movable block through a eccentric column, the operating member drives the locking block to rotate, the locking block drives the movable block to move through the eccentric column, the movable block connect to the force transmission mechanism. Of course, the specific configurations of the rotating component or the moving component are not limited to the one described herein, and adjustment may be made depending on the specific situation, and is not limited herein.

The locking unit 2 can use the locking mechanism, the locking unit 2 comprises a lock head and a lock hook, the lock head can also be called lock catch, the lock hook can be called a locking tab; usually the lock head is mounted to the side of the suitcase border through a lock bracket (also called the lock seat), and the lock head and the lock bracket can be relatively moved; the lock hook mounted to the other side of the suitcase border, and with respect to the lock position, which is convenient to connect the lock head and the lock hook.

The force transmission mechanism can use a wire drawing mechanism or a rope pulling mechanism or other type of force transmission mechanism, and the mentioned here is non-mandatory limitation; the force transmission mechanism connects the lock head or the lock hook with the rotating component or the moving component, the rotating component rotate or the moving component move so as to drive the lock head or the lock hook to move. When one cover and the other cover of the suitcase are closed, operating the operating member drives the rotating component or the moving component, and then transfer the force by the transferring mechanism to make the lock head or the lock hook to move, in the process of moving the locking or unlocking function of the lock hook and the lock head is realized. Wherein, the force transferring mechanism can drive the lock head to move relative to the lock hook, and also can drive the lock hook move relative to the lock head, the mentioned here is non-mandatory limitation, the present invention is described with the force transmission mechanism to drive the lock head as an example to explain.

The lock set on a suitcase of being opened or closed without using a zipper which provided by the invention, the operating component further includes an open-close locking mechanism for controlling the movement or locking of the rotating component or the moving component, and a self-locking mechanism for self lock of the operating member, wherein, the opening-closing mechanism may be a code lock or a key lock form, there is no restriction; the self-locking mechanism of the specific form of the structure is not restricted also.

The lock set on a suitcase of being opened or closed without using a zipper provided by the invention, the number of the setting of the locking unit 2 is not limited, and two locking units 2 are usually provided, and the connecting relationship between the two locking units 2 is not limited.

For example, as shown in FIG. 1, two locking units 2 are arranged on the force transmitting mechanism 3 in series, the force transmission mechanism 3 driving the lock head of the two locking part 2 simultaneously to move to the same side.

Figure 4:
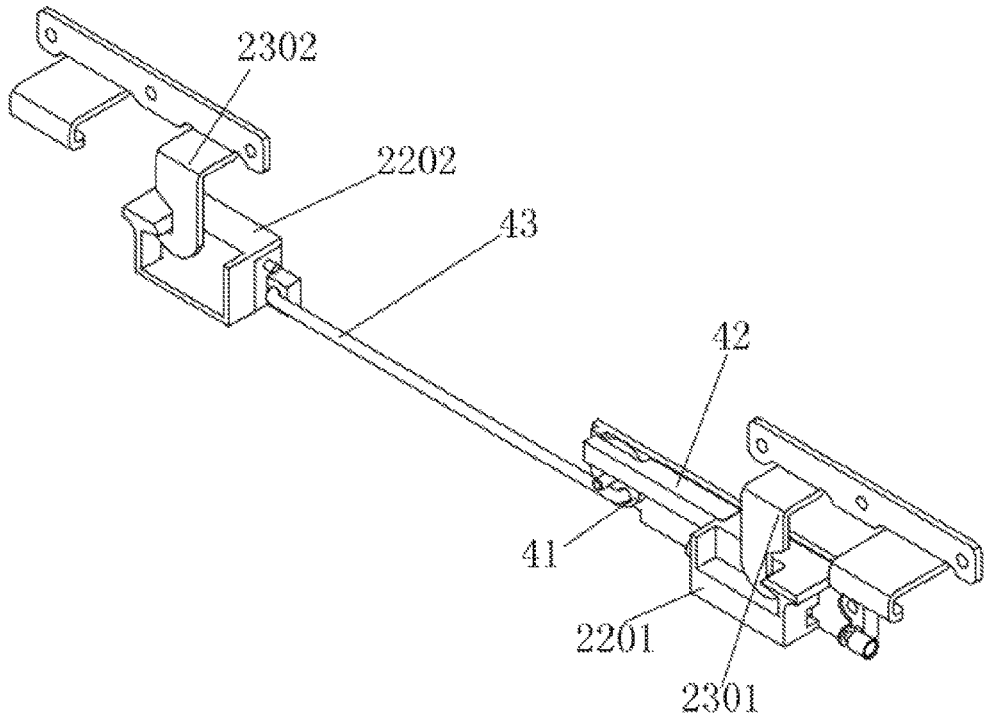
FIG. 4 is the schematic diagram of the connection of the two operating component in FIG. 2.
Figure 5:
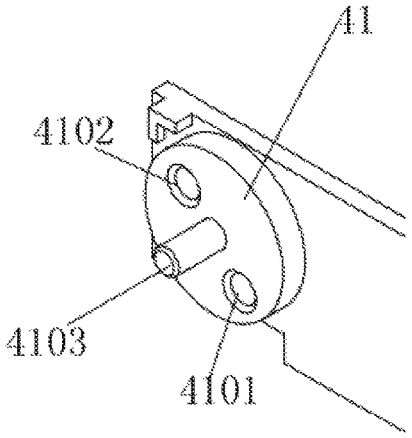
FIG. 5 is a schematic view of the structure of the rotary table in FIG. 2.
Figure 6:
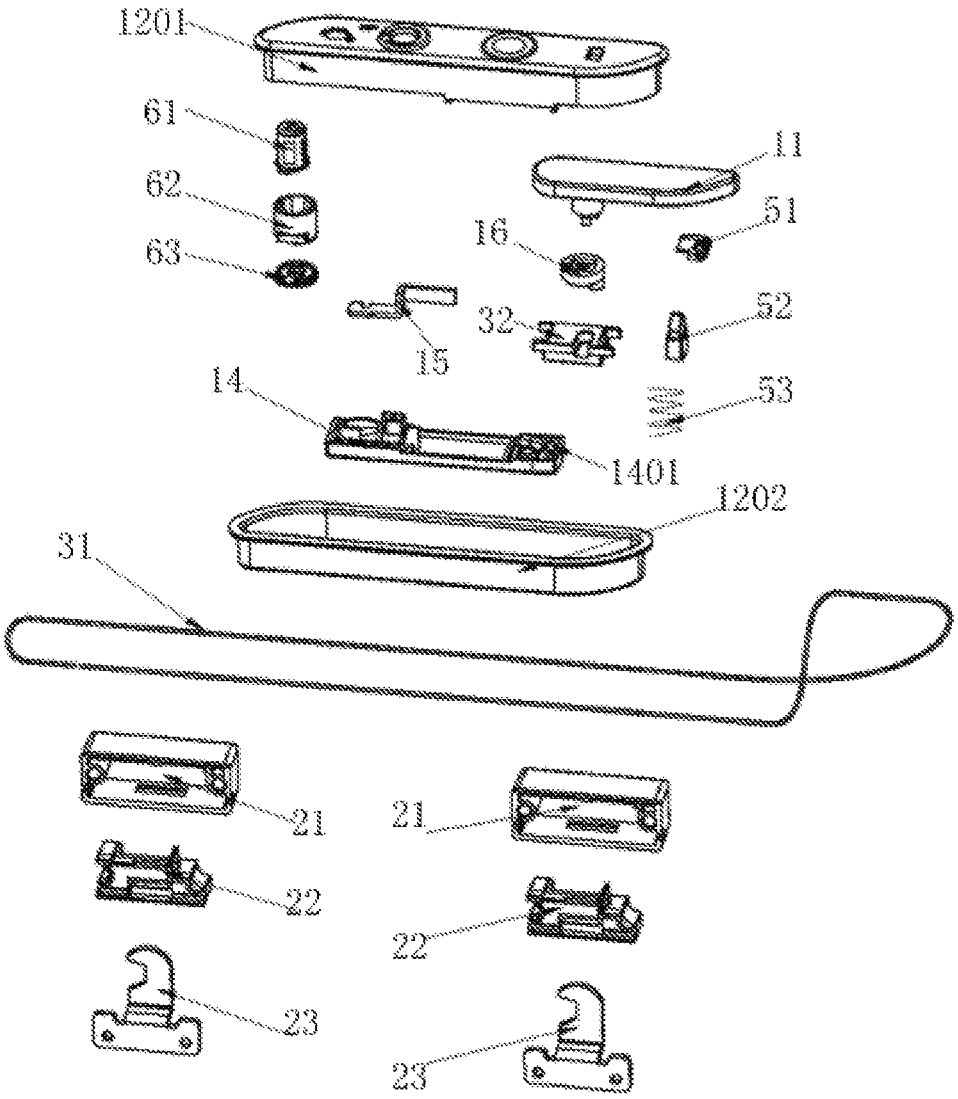
FIG. 6 is the split schematic diagram of the first embodiment of the lock provided by the invention.

Another example as shown in FIG. 3 to FIG. 5, two locking component comprises a first locking unit and a second locking unit, the first locking unit comprises a first lock head 2201 and a first lock hook 2301, and the second locking unit comprises a second lock head 2201 and a second lock hook 2302, the force transmitting mechanism 3 connect with the first lock head 2201, and drives the first lock head 2201 to move; the second lock head 2202 is connected to the first lock head 2201 through a steering mechanism 4, when the first locking hook 2301 and the second locking hook 2302 are arranged, the hook parts of the first locking hook 2301 and the second locking hook 2302 towards opposite.

As shown in FIG. 4 to FIG. 5, the steering mechanism includes a rotary table 41, a first connecting rod 42 and a second connecting rod 43, the rotary table 41 is mounted on the lock bracket through a shaft 4103, and can revolve round the shaft 4103; the rim of the rotary table 41 is provided with a first connecting rod mounting holes 4102 and a second connecting rod mounting hole 4101, and the first connecting rod mounting hole 4102 and the second connecting rod mounting hole 4101 may be located in the same radial direction; the first lock head 2201 is connected to the first connecting rod mounting hole 4102 of the rotary table 41 through the first connecting rod 42, one end of the second connecting rod 43 is connected to the second connecting rod mounting hole 4101 of the rotary table 41, and the other of the connecting rod 43 is connected to the second lock head 2202 and the first connecting rod 42 is parallel to the second connecting rod 43; when the first lock head 2201 moves towards one side and separates itself from the first lock hook 2301, the first connecting rod 42 drives the rotary table 41 to rotate, and the rotary table 41 rotates to drive the second connecting rod 43 to move towards the other side, and make the second lock head 2202 to move towards the other side to achieve separation with the second lock hook 2302.

The lock of the present invention that set a suitcase of being opened or closed without using a zipper realizes separation of the operating component and the locking component, the structure design is simple and easy arranged, the set position of the lock is not restricted on the suitcase, avoid the problem of lock being easily damaged and inconvenient operation which caused by the lock must be set on the border side of the suitcase.

Further description of the lock set on a suitcase of being opened or closed without using a zipper of the present invention combining with specific examples of execution in the following.

Embodiment 1

Please refer to FIG. 6 to FIG. 14, a lock set on a suitcase of being opened or closed without using a zipper, including an operating component 1 and a locking component, the locking component comprises at least one locking unit 2, the operating component and the locking component are connected by a force transmission mechanism 3.

The operating component 1 including an operation member, a handle 11 is applied as the operating member 1 in the example of execution; the operation component 1 further comprises a cover 1201, a bottom shell 14, a cover plate 14, a moving part 32 and a locking block 16, the cover 1201 and the bottom shell 1202 are fixedly connected, and the cover 1201 and the bottom shell 1202 cooperate to form an accommodating space, and the combination of the cover 1201 and the bottom shell 1202 forms a lock body; the handle 11 is disposed outside the cover 1201.

Figure 7:
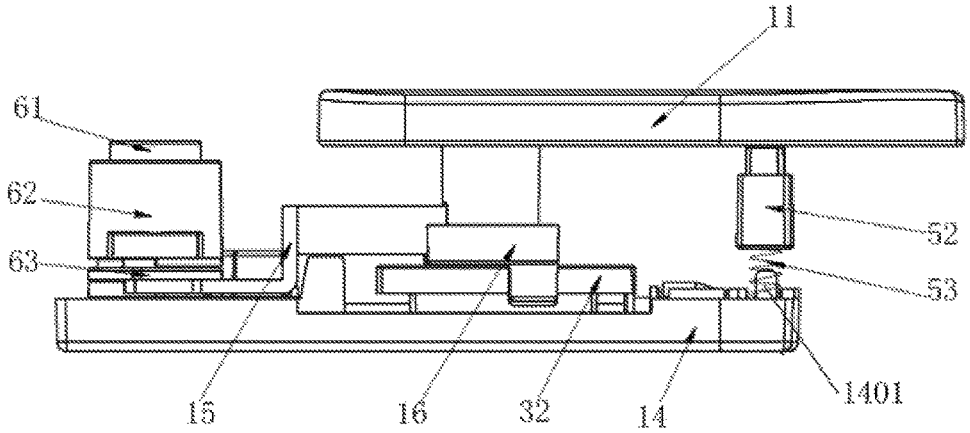
FIG. 7 is an internal schematic view of the operating component in first embodiment of the lock provided by the invention.
Figure 8:
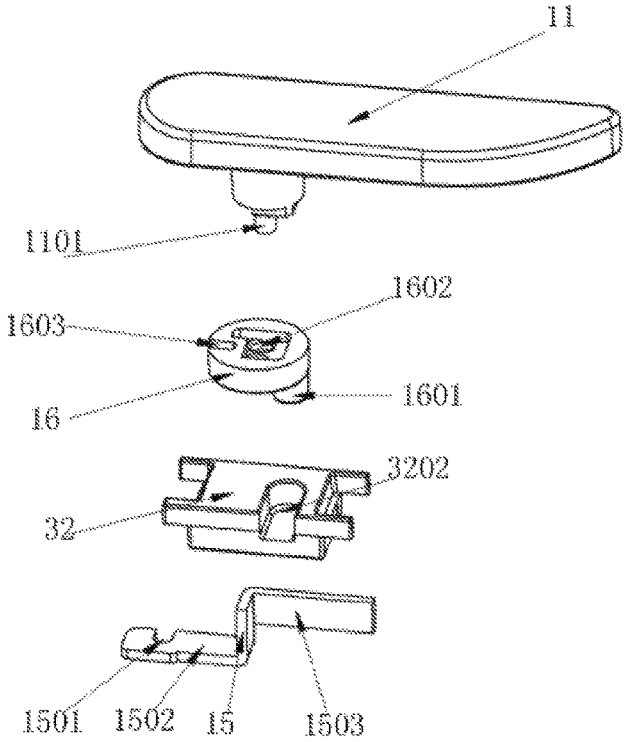
FIG. 8 is an exploded view of the lock block, movable block, locking plate in first embodiment of the lock provided by the invention.
Figure 9:
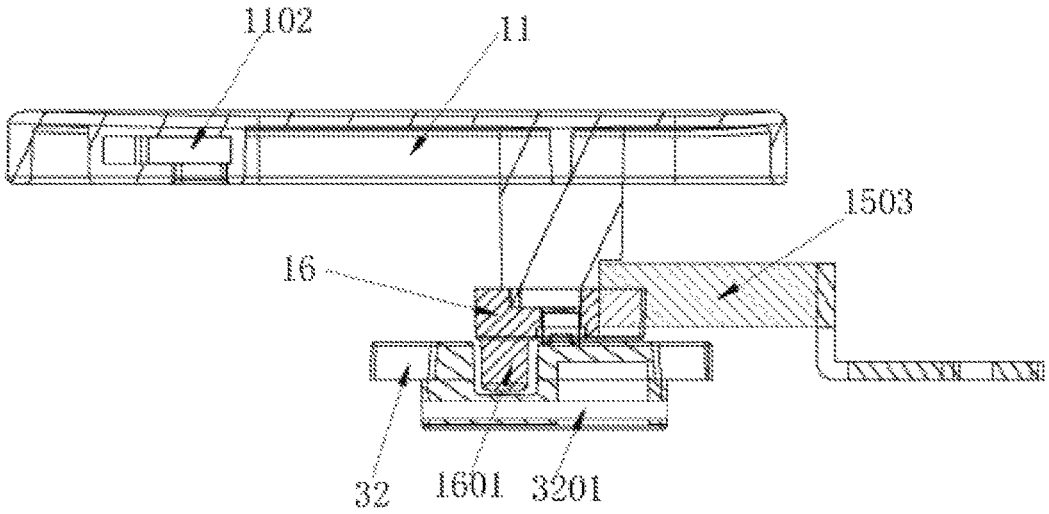
FIG. 9 is a structural split diagram of the lock block, movable block, locking plate in first embodiment of the lock provided by the invention.

As shown in FIG. 7 to FIG. 9, the cover plate 14, the movable block 32 and the locking block 16 are set in the accommodating space which the cover and the bottom shell cooperately forms, a chute is formed in the cover plate 14, the movable block 32 is set in the chute and slideable along the chute, a first clamping groove 3202 formed in the top of the movable block 32, the bottom of the locking block 16 is provided with a first eccentric column 1601 which is matched with the first clamping groove 3202, and the first eccentric column 1601 is inserted into the first clamping groove 3202 to realize the connection; a first positioning column 1101 is set at the bottom of the handle 11, the top of the locking block 16 is provided with a positioning hole 1101 which is matched with the first positioning column 1602, and the positioning column 1101 is fixedly connected with the positioning hole 1602 through the cover 1201, the handle 11 is rotated to drive the locking block 16 to rotate, and the locking block 16 rotating drives the movable block to move along the chute of the cover plate 14 through the first eccentric column 1601.

Figure 12:
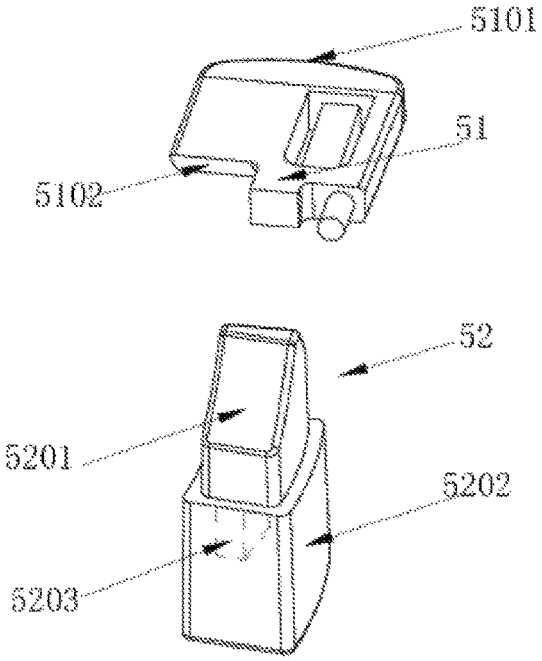
FIG. 12 is a structural split diagram of the pushing block and the top block in first embodiment of the lock provided by the invention.
Figure 13:
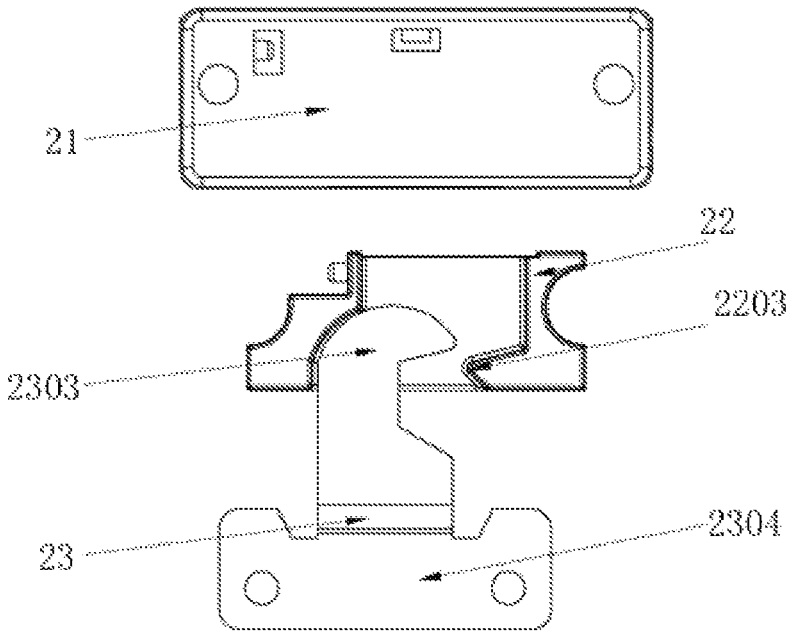
FIG. 13 is a structural split diagram 1 of the locking unit in first embodiment of the lock provided by the invention.
Figure 14:
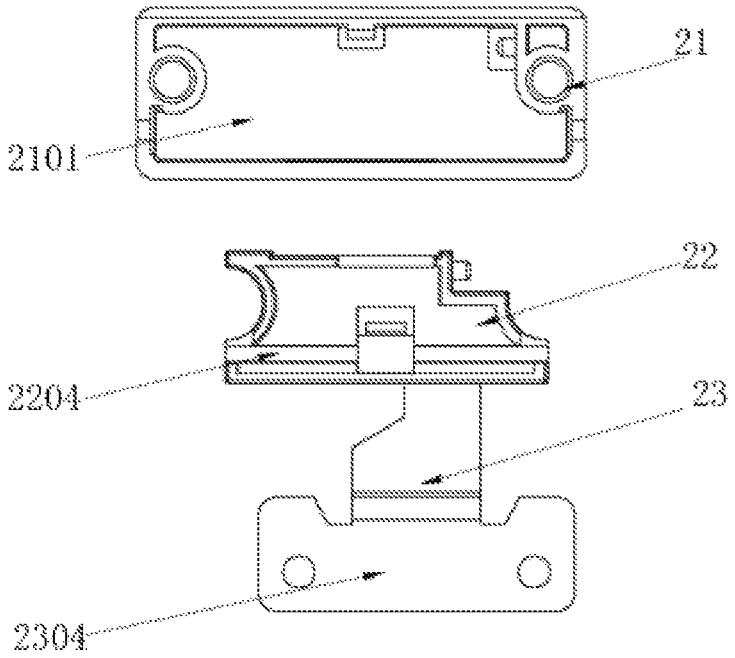
FIG. 14 is a structural split diagram 2 of the locking unit in first embodiment of the lock provided by the invention.
Figure 15:
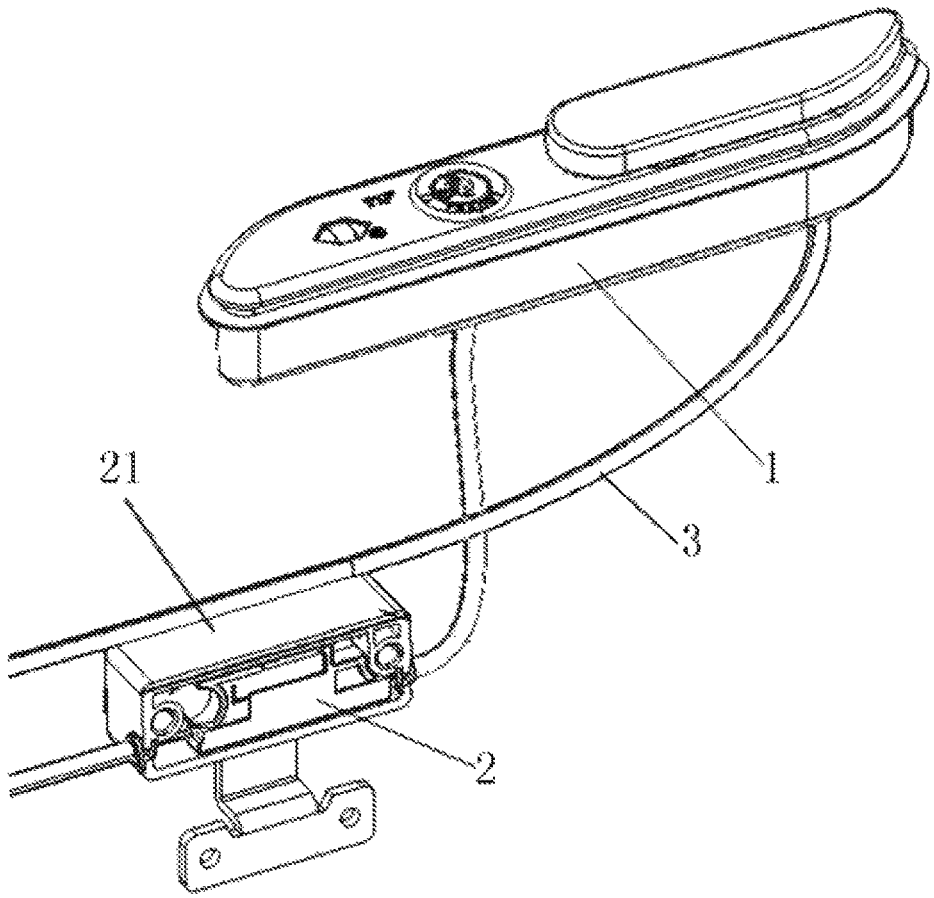
FIG. 15 is a structure diagram of second embodiment of lock provided by the invention.

In the present embodiment, the operating component further includes a self-locking mechanism, the self-locking mechanism is set between the handle 11 and the cover plate 14; as shown in FIG. 7 and FIG. 12, the self-locking mechanism comprises a pushing block 51 and a top block 52, the pushing block 51 comprises a push button part 5101 and an abutting part 5102, the top block 52 comprises a protruding part 5201 and a first fixed part 5202; a second positioning column 5203 is set on the bottom of the fixed part 5202, a third positioning column 1401 is set on the cover plate 14, the third positioning column 1401 is positioned right below the second positioning column 5203, a spring 53 is sleeved between the second positioning column 5203 and the third positioning column 1401; a first accommodating groove 1102 is formed in the bottom of the handle 11, the abutting part 5102 of pushing block 51 and the protruding part 5201 of the top block 52 are set perpendicular to each other, the abutting part 5102 and the protruding part 5201 are all located in the first accommodating groove 1102; the abutting part 5102 abuts against the protruding part 5201, and abutting part 5102 is in contact with the inclined surface of the protruding part 5201, so as to realize the locking between the handle 11 and the cover plate 14; when the push button part 5101 is pushed in the horizontal direction so that the pushing block 51 enters into the first accommodating groove 1102 while the abutting part 5102 pushes protruding part 5201, the protruding part 5201 is caused to move downward in the vertical direction under the action of the inclined surface, and is pushed out of the first accommodating groove 1102, so that the handle 11 is separated from the top block 52, so that unlocking of the handle 11 is achieved.

The user presses the pushing block 51, the pushing block 51 will be fully inserted into the first accommodating groove 1102, the abutting part 5102 of pushing block 51 will sliding cooperate with one of the ramp surface of the protruding part 5201, and push the protruding part 5201 from the first accommodating groove 1102, relieves the lock state, and the handle 11 can rotate, and the spring 53 is compressed; when the abutting part 5102 of the pushing block 51 moves over the other inclined surface of the protruding part 5201 of the top block 52, the top block 52 resets the pushing block 51 from the first accommodating groove 1102 under the action of the spring 53, turn back to the self-locking state, and the handle 11 can not rotate. The invention can prevent the handle 11 from rotating freely under the condition that the case is closed.

Figure 10:
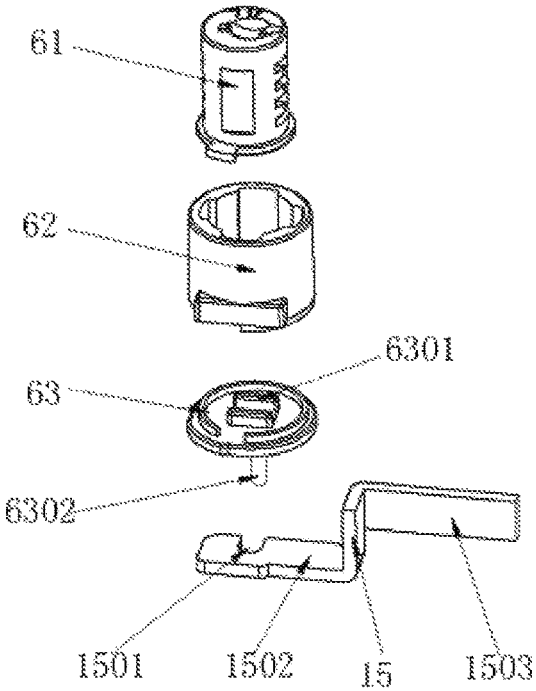
FIG. 10 is a split diagram of a open-close locking mechanism in first embodiment of the lock provided by the invention.
Figure 11:
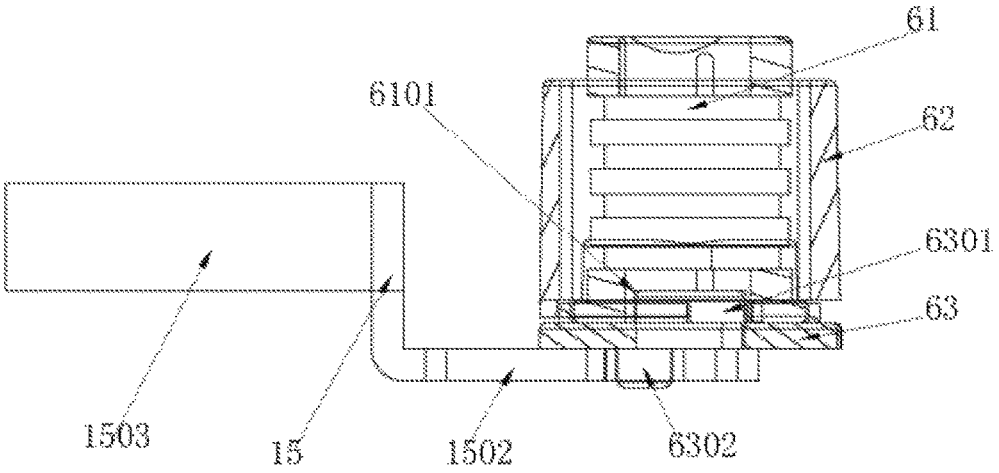
FIG. 11 is a structural split diagram of the open-close locking mechanism and locking plate in first embodiment of the lock provided by the invention.

In the example of execution, the operating component further includes an open-close locking mechanism, the open-close locking mechanism may be a code lock or a key lock Form, there is no restriction; as shown in FIG. 10 to FIG. 11, the open-close locking mechanism includes a lock core 61, a lock core sleeve 62, and a rotating block 63; the lock core sleeve 62 sleeved on the lock core 61, the rotating block 63 is set at the bottom of the lock core 61; the cover plate 14 is provided with a second accommodating groove, the rotating block 63 set in the second accommodating groove, a fourth positioning column 6301 is set on the top of the rotating block 63, a positioning groove 6101 is set at the bottom of the lock core 61, the positioning slot 6101 matchs with the fourth positioning column 6301, the lock core 61 rotates to drive the rotating block 63 to rotate.

The rotating block 63 is connected with the locking block 16 through a locking piece 15, specifically, the locking piece 15 comprises a first hook part 1501, a moving part 1502 and a connecting part 1503, wherein, the moving part 1502 is located between the first hook part 1501 and the connecting part 1503; the bottom of the rotating block 63 is provided with a second eccentric column 6302 which is matched with the first hook part 1501, the rotating block 63 rotates to move the locking piece 16 through the second eccentric column 6302; the locking block 16 is provided with a second clamping groove 1603 which matches the connecting part 1503 at the other end of the locking piece 15, the connecting part 1503 is inserted into the second clamping groove 1603 to realize connection.

The open-close locking mechanism is located in the accommodating space formed by the cover 1201 and the bottom shell 1202, and the key hole at the top of the lock core 61 protruded from the cover 1201. The user inserts the key into the key hole of the lock core 61, and then turns the lock core 61, the lock core 61 drives the rotating block 63 to rotate through the positioning groove 6101 and fourth positioning column 6301, and the rotating block 63 drives the locking plate 15 to move through the second eccentric column 6302, the lock plate 15 is inserted into the second clamping groove 1603 of the locking block 16 in the process of moving, or pushes out the second clamping groove 1603, so as to control the rotation of the locking block 16, to control whether the handle 11 can drive the locking block 16 to rotate to unlock the lock. The invention realizes the double locking of the lock through the setting of the open-close locking mechanism, and it is safe and reliable.

In this embodiment, the locking unit 2 may be a latch mechanism, the locking unit 2 includes a lock bracket 21, a lock head 22, a lock hook 23, the lock head 22 is set on the suitcase through the lock bracket 21, a third accommodating groove 2101 is formed in the lock bracket 21, the lock head 22 is set in the third accommodating groove 2101, and can move along the third accommodating groove 2101, a second hook part 2203 is set on one side of the lock head 22. The hook 23 is composed of a third hook part 2303 and a fixing portion 2304. The lock hook 23 is attached to the suitcase by the first fixed part 2304, and the third hook part 2303 is matched with the second hook part 2203, the second hook part 2203 and the third hook part 2303 can be engaged with or separated from each other by the movement of the lock head 22, and to realize opening or locking of the suitcase.

In this example of execution, a wire drawing mechanism is applied for the force transmitting mechanism, the wire drawing mechanism includes a steel wire 31, the steel wire 31 connects the movable block 32 to the locking unit 2, the movable block 32 pulling the steel wire 31 during its movement, similar to the bicycle brake principle, by pulling the steel wire 31, the locking unit 2 open the case cover of the suitcase, the invention has simple unlocking method and strong safety. Specifically, the bottom of the movable block 32 is provided with a first clamping slot 3201, and the first clamping slot 3201 clamping a steel wire 31; the other side of the lock head 22 set on a second clamping slot 2204 which is used for clamping the steel wire 31, so that the movable block 32 moves to drive the lock head 22 to move. In addition, the rest part of the steel wire is provided with a rubber sleeve 8 except the part being clamped in the first clamping slot 3201 and the second clamping slot 2204, in order to protect the steel wire 31 from external force; the portion of the steel wire 31 provided in the first clamping slot 3201 is not provided with the rubber sleeve 8 so that the wire 31 can move the lock head 22 when the movable block 32 is pulled.

The lock set on a suitcase of being opened or closed without using a zipper provided by the invention, the working principle is as follows:

The user inserts the key into the key hole of the lock core 61, and then turns the lock core 61, the rotating block 63 rotate along with the lock core 61, due to the design of the second eccentric column 6302 at the bottom of the rotating block 63, when the rotating block 63 rotates, it drives the locking plate 15 to move, the connecting part 1503 of the locking piece 15 is pulled out from the second clamping groove 1603 of the locking block 16.

The user presses the pushing block 51, the pushing block 51 will be fully inserted into the first accommodating groove 1102, the protruding part 5201 is pushed out from the first accommodating groove 1102 by the pushing block 51, relieving the lock state of the handle 11.

The user then turns the handle 11, the handle 11 causes the locking block 16 to rotate together; due to the design of the first eccentric column 1601 at the bottom of the locking block 16, when the locking block 16 is rotated, the movable block 32 is caused to move in the chute of the cover plate 14; the movable block 32 pulls the steel wire 31 during its movement, and the steel wire 31 drives the lock head 22 to move within the third accommodating groove 2101 of the lock bracket 21, the movement of the lock head 22 causes the second hook part 2203 of the lock head 22 to be disengaged from the third hook part 2303 of the lock hook 23, and then the case cover can be opened.

Embodiment 2

Please refer to FIG. 15 to FIG. 20, a lock set on a suitcase of being opened or closed without using a zipper, including an operating component 1 and a locking component, the locking component comprises at least one locking unit 2, the operating component and the locking component are connected by a force transmission mechanism 3.

In the present embodiment, the operating component 1 includes a lock body mechanism an operation member, the lock body mechanism comprises a lock body 12 and a rotating component, the rotating component includes a rotating shaft 13, the rotating shaft is arranged in the lock body 12, and the rotating shaft 13 can rotate relative to the lock body 12. A toggle 11 is applied for the operating member 1 in the present example; the toggle 11 is connected with the rotating shaft 13, the user drives the toggle 11 to drive the rotating shaft 13 to rotate relative to the lock body 12; of course, the specific structure of a toggle 11 is not limited to that shown in FIG. 14, it can also be designed according to the specific circumstances, the main purpose of the toggle is easy for users to manually rotate the rotating shaft 13.

The toggle has a limiting structure which is used for defining a maximum rotation angle, the preferred angle of rotation of the toggle 11 is defined as 120 degrees, the specific structure of the limiting structure and the limiting angle can be set according to the specific situation, there is no limitation here; the invention limits the maximum rotating angle of the toggle 11, increasing the operating feeling and reliability of the toggle.

Figure 18:
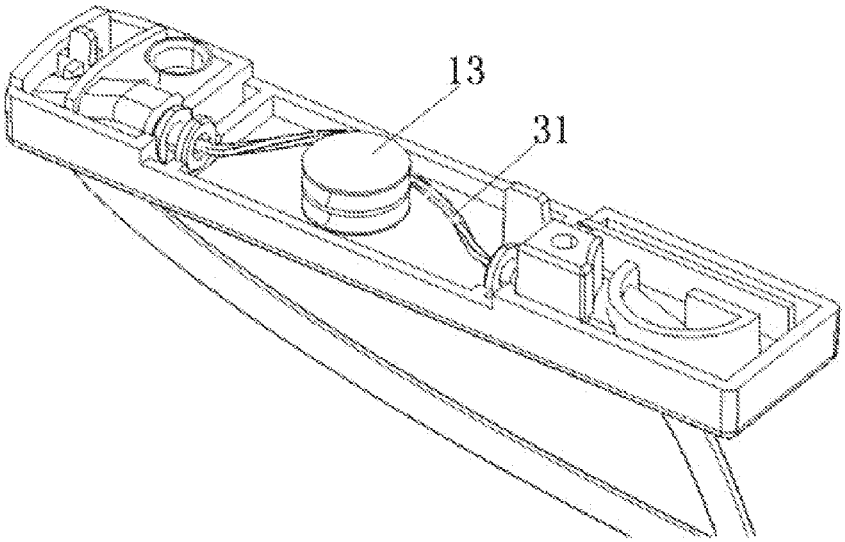
FIG. 18 is a three-dimensional diagram of internal structure of the lock body in second embodiment of lock that set on a suitcase of being opened or closed without using a zipper provided by the invention.
Figure 19:
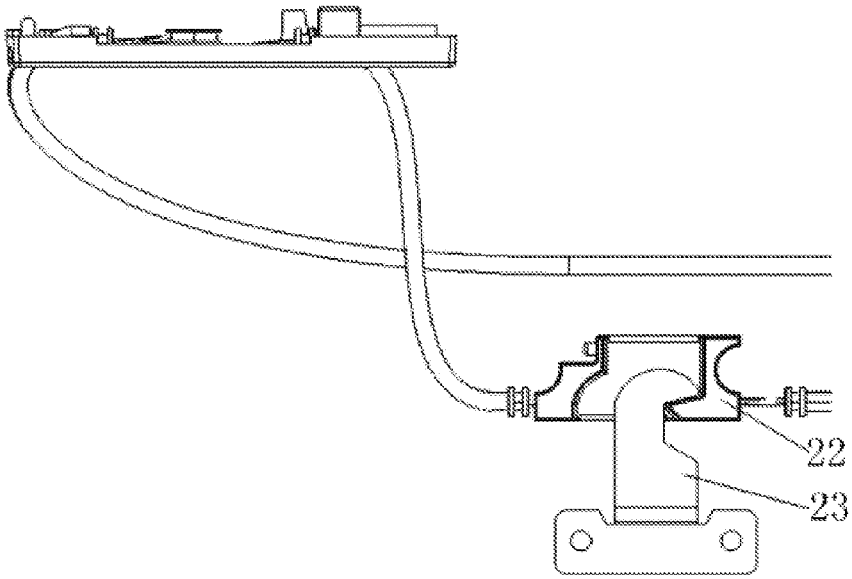
FIG. 19 is a connection structure diagram of the lock head and the lock hook in second embodiment of lock that set on a suitcase of being opened or closed without using a zipper provided by the invention.
Figure 20:
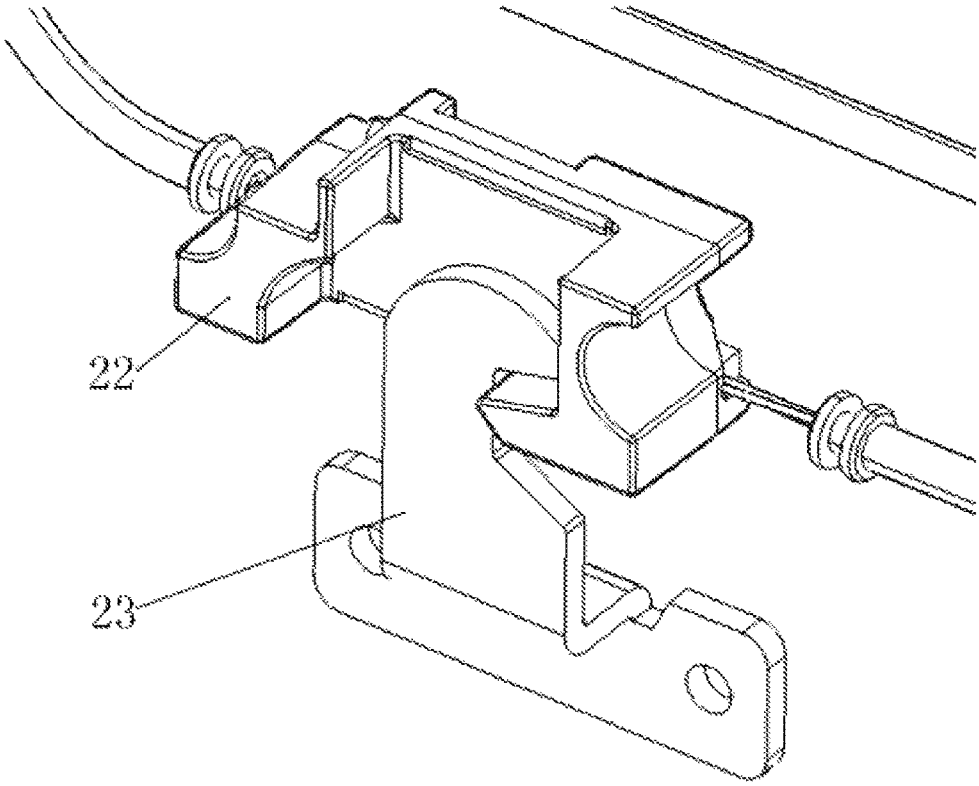
FIG. 20 is a large view of the connection structure of the lock head and the lock hock in second embodiment of lock that set on a suitcase of being opened or closed without using a zipper provided by the invention.

In the present example of execution, the number of the locking unit 2 is not limited, a lock can include 1 or 2 to 3 locking units, the number of locking unit 2 can be set according to specific circumstances, the locking unit 2 comprises a lock head 22 and a lock hook 23, as shown in FIG. 18 to FIG. 19, the lock head 22 is disposed inside a lock bracket 21, and the lock head 22 is movable relative to the lock bracket 21, and the lock head 22 is mounted to the target position through the lock bracket 21; a hook part is provided on one side of lock head 22, and a hook part is also provided on the lock hook 23, the lock head 22 is moved so that the hook 23 engages or separates from the hook part of the lock head 22.

Figure 16:
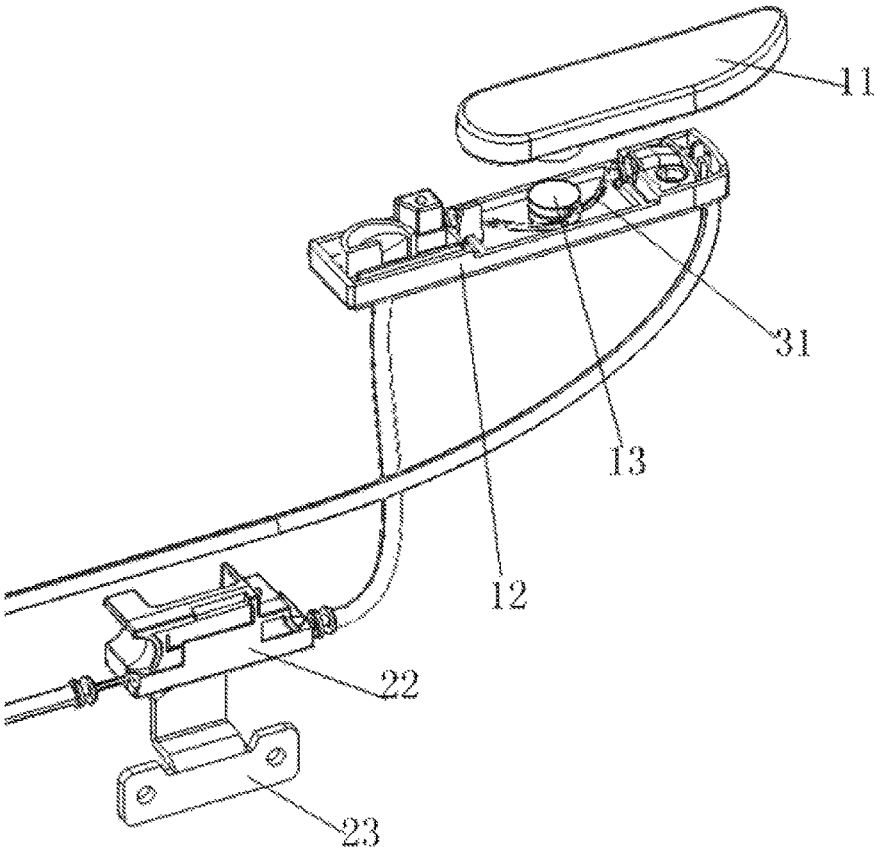
FIG. 16 is an internal detailed structure diagram of FIG. 15.
Figure 17:
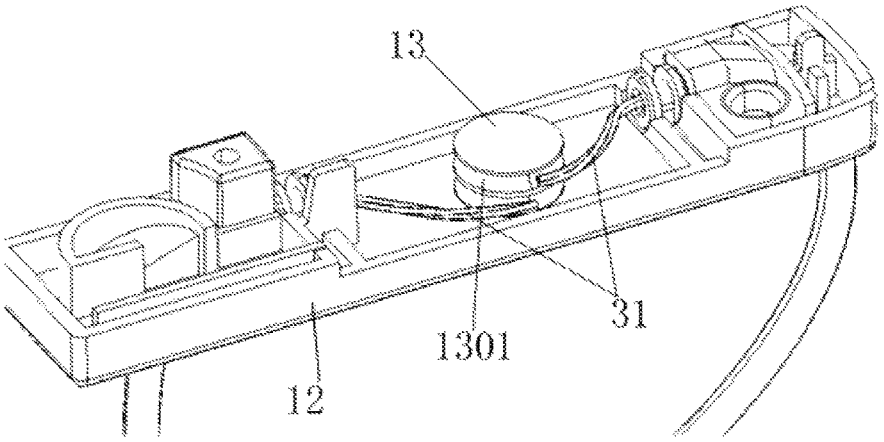
FIG. 17 is a larger view of internal structure of the lock body in second embodiment of lock provided by the invention.

In the present example of execution, a rope pulling mechanism is applied for the force transmitting mechanism, the rope pulling mechanism includes a locking rope 31, the locking rope 31 connects the rotating shaft 13 with the lock head 22; Specifically, the locking rope 31 connected with the lock head 22, and the fastening surface of the lock head 22 and the lock hook 23 are parallel to the locking rope 31; as shown in FIG. 16, two parallel guiding grooves 1301 are set in the circumferential direction of the rotary shaft 13, after the locking rope 31 is connected to the lock head 22, the two ends of the locking rope 31 are respectively set in the two guiding grooves 1301, the two connecting parts of the two ends of the locking rope 31 with the two guiding grooves 1301 are located in the position of same radial direction of the rotating shaft 13. The invention set guiding grooves 1302 on the rotating shaft 31, the guiding groove guides the locking rope, and prevents the locking rope 31 from moving upper and lower in the lock body.

In this example of execution, the lock set on a suitcase of being opened or closed without using a zipper provided by the present invention further includes a self-locking mechanism, the self-locking mechanism is used to lock the toggle 1 so as to prevent the toggle 1 from rotating erratically when the lock is not required to be opened, the specific structure of the self-locking mechanism can be described with reference to the one in embodiment 1.

In this example of execution, the lock set on a suitcase of being opened or closed without using a zipper provided by the present invention is installed at the upper corner of the front surface of the suitcase in a sunken way, the rotating surface of the toggle is perpendicular to the plane where the lock hook and lock head is located.

The invention employs a manner in which the locking rope 31 and the rotary shaft 13 are matched to each other, when the toggle 1 drives the rotating shaft 13 to rotate, because the two ends of the lock rope 31 are fixed at the position of the same radial direction of the side of the rotating shaft, and the rotating shaft 13 can drive the locking rope 31 to move back and forth slightly, then the lock rope 31 can drive the lock head 22 slightly move back and forth, so as to realize the buckling or separation of the lock head 22 and the lock hook 23. The degree of freedom of the locking rope 31 is very high, it can transfer in any direction, so as to select the set position of the lock in the suitcase body, to increase the degree of freedom.

The invention has a novel structure, the set of the lock on the suitcase is very freedom and convenient; the lock set on the front of the suitcase in the sunken way, shape aesthetic, and when shipped the suitcase will not be damaged by the impact; the locking rope own high degree of freedom, the structure arrangement is convenient; the connection structure of the rotating shaft with the locking rope is simple and unique; a toggle is used as the handle for the switch lock, feel good, generous and convenient.

The invention also provides a suitcase which comprises an upper cover and a lower cover which are fastened together, wherein the connection part of the upper cover and the lower cover are provided with a border, the suitcase is further provided with a lock, the lock comprises an operating component 1 and a locking component, the operating component 1 and the locking component are connected through a force transmission mechanism, the locking component is provided inside the suitcase border, the operating component 1 is concavely formed in the outer surface of the suitcase except the border of the suitcase; the locking component comprises a lock head and a locking hook which are respectively arranged on the upper cover and the lower cover of suitcase, for realizing the locking function. The specific structure of the lock may refer to any of the above-described locks, and the description will not be repeated here.

The following is a specific example to further illustrate the suitcase provided by the invention:

Embodiment 1 of Suitcase

Figure 21:
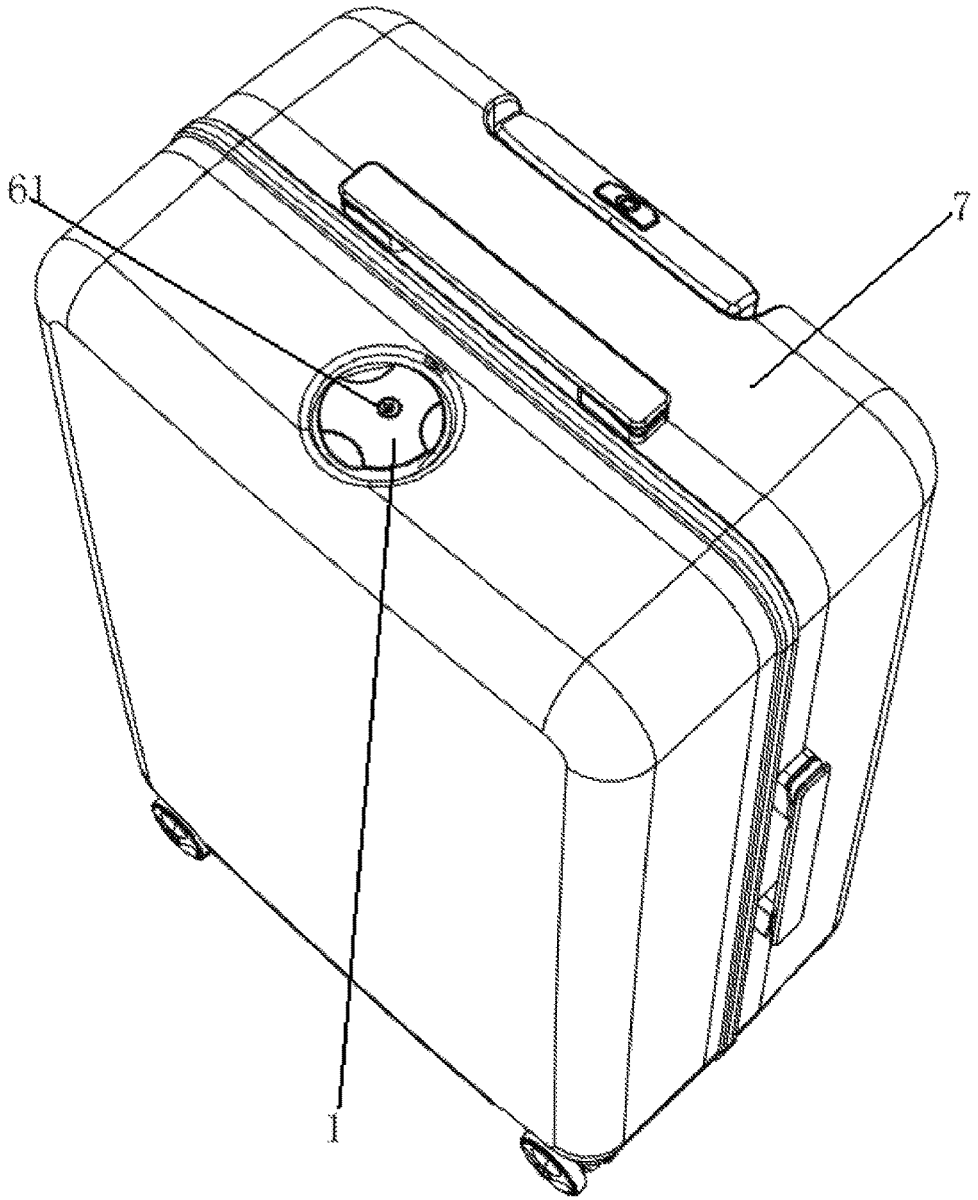
FIG. 21 is a structure diagram 1 in first embodiment of suitcase provided by the invention.
Figure 22:
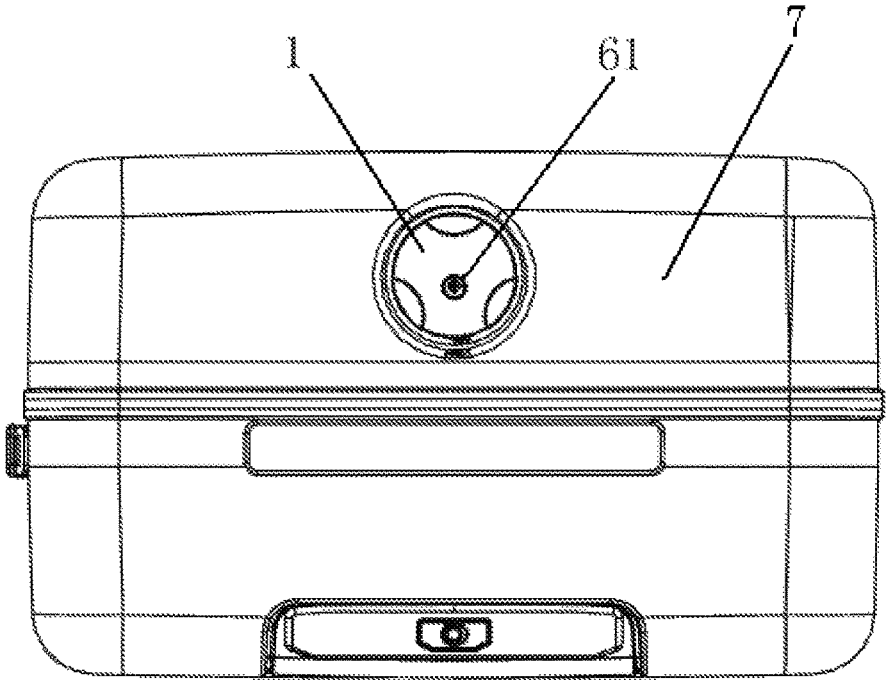
FIG. 22 is a structure diagram 2 in first embodiment of suitcase provided by the invention.
Figure 23:
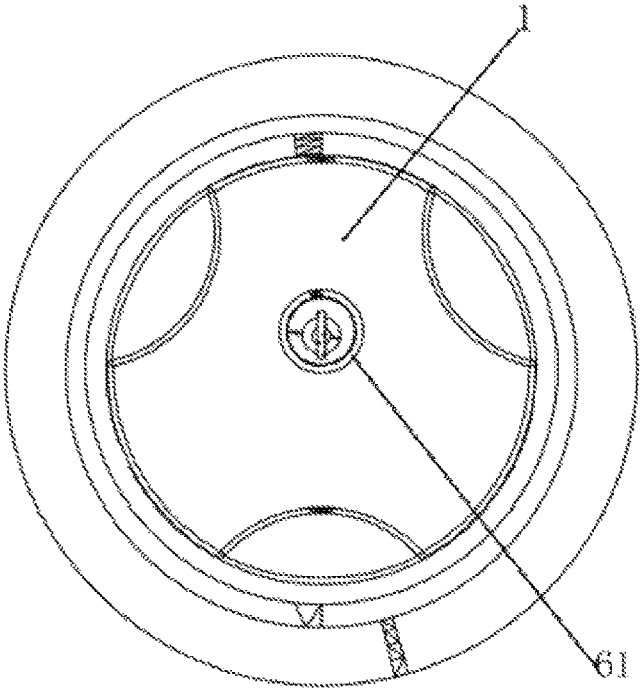
FIG. 23 is a structure diagram of the operating component of the lock of the suitcase in first embodiment provided by the invention.

Please refer to FIG. 21 to FIG. 23, in this example of execution, the operation component 1 is disposed on the upper surface of the suitcase 7, and is disposed in the middle of the upper surface and beside to the front side of the suitcase.

In this example of execution, the shape of the operation component is circular, the operation component 1 is also provided with a structure which is convenient for manual opening, the structure which is convenient for manual opening is three inward concave structures that arranged in the circular operating component on the outer contour so that it is convenient for manual opening with hand grip.

In this example of execution, a lock core 61 is further integrated on the operation component 1, which is convenient to open and lock with a key.

In this example of execution, the operation component is a spring-loaded structure, the operating component 1 is recessed on the surface of the suitcase when not in use, and the operating component is pushed out by pressing the operating component 1 when in use, and then it is unlocked or locked by operation.

In this example of execution, the operating component opens the locking component by rotating.

Embodiment 2

Figure 24:
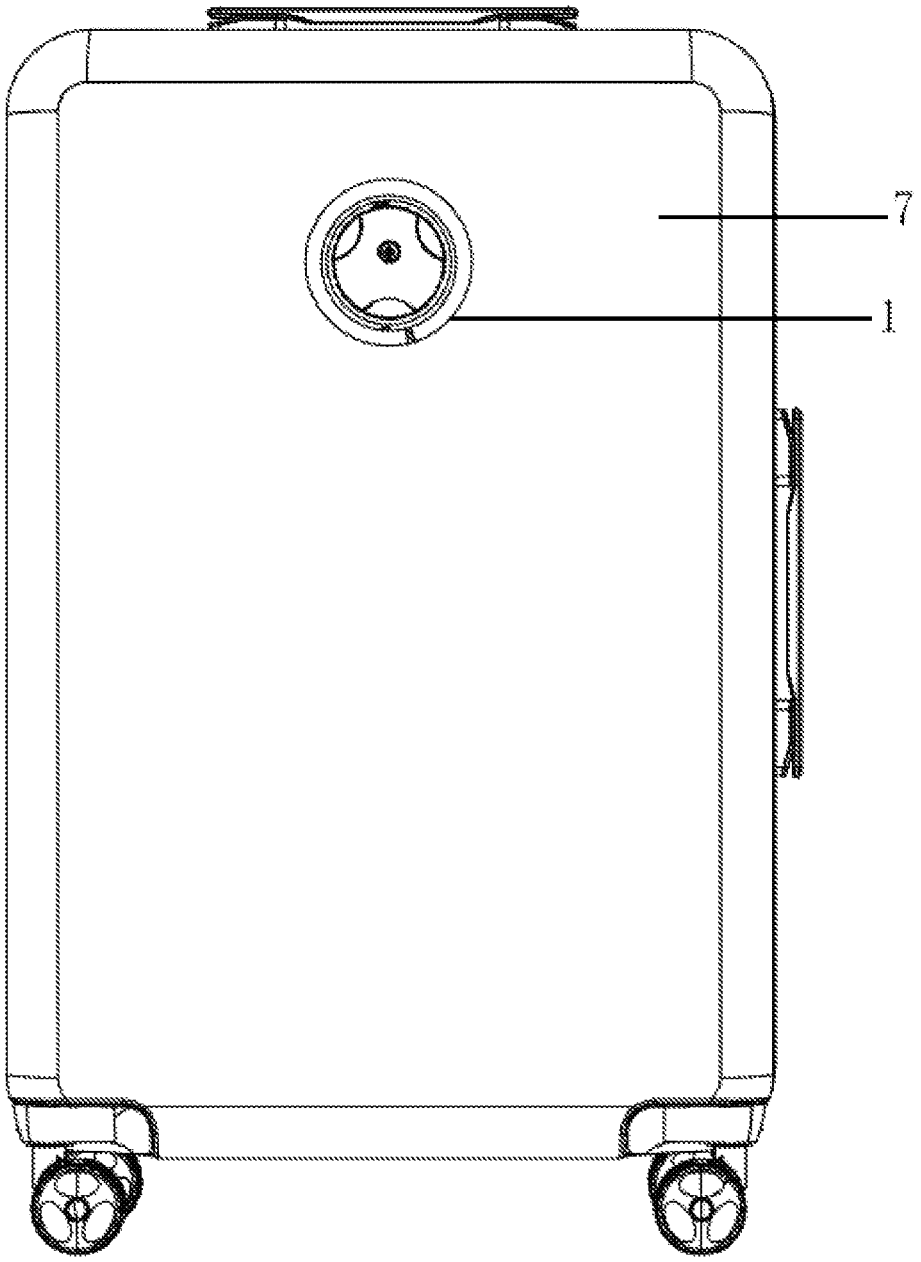
FIG. 24 is a structure diagram 1 in second embodiment of suitcase e provided by the invention.
Figure 25:
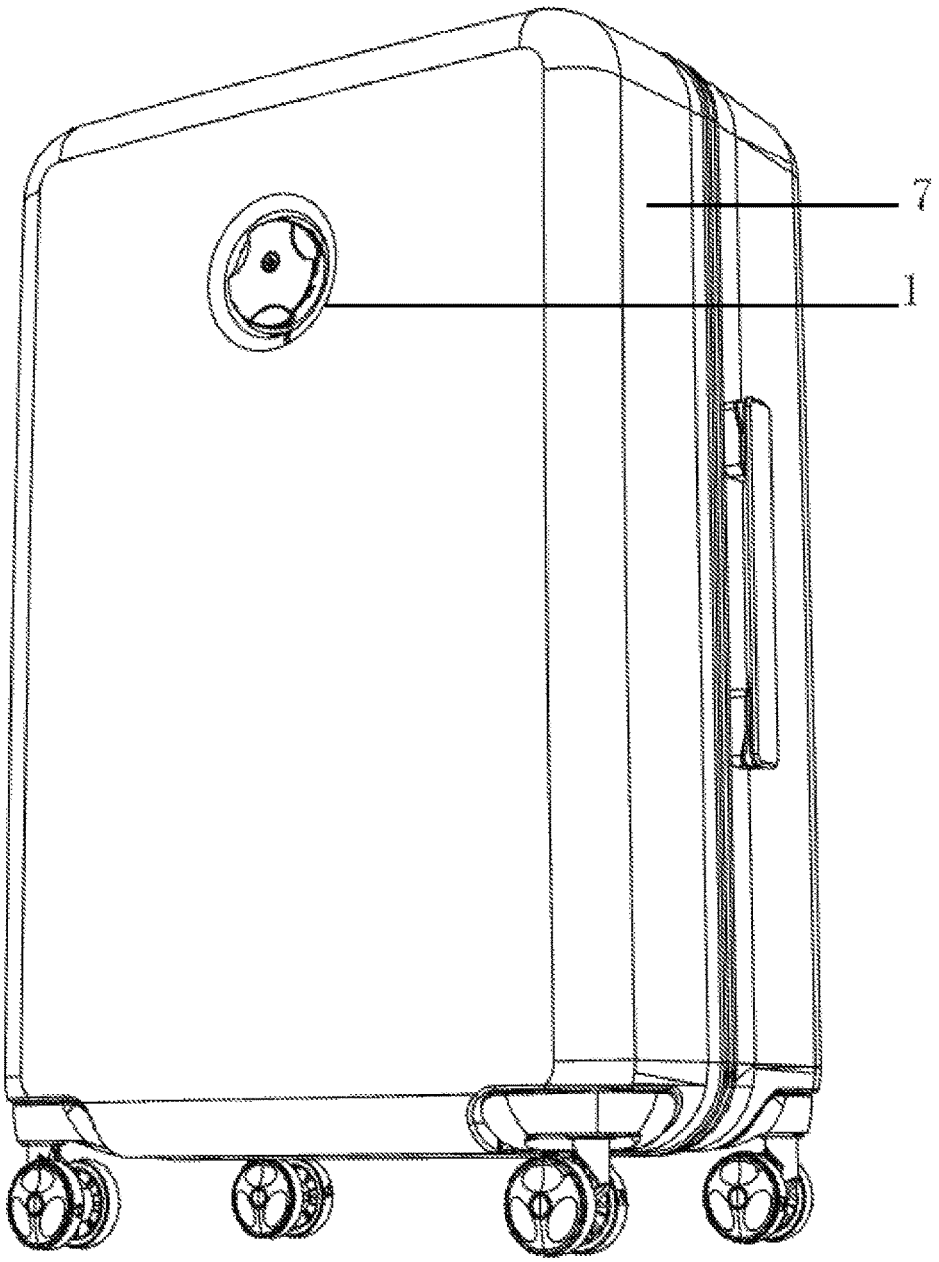
FIG. 25 is a structure diagram 2 in second embodiment of suitcase provided by the invention.

Please refer to FIG. 24 to FIG. 25, a suitcase which provides in this example of execution, unlike the embodiment 1, the operating component is set in an upper middle portion of the front surface of the suitcase 7. The remaining technical features are the same as the embodiment 1, and the description will not be repeated here.

Embodiment 3

Figure 26:
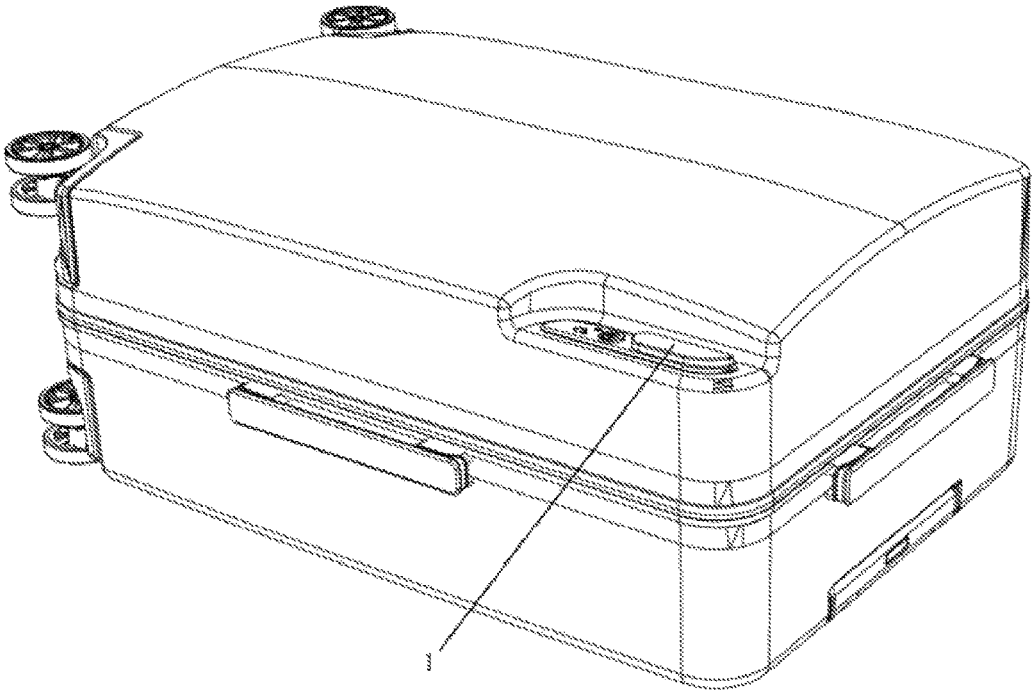
FIG. 26 is a structure diagram in third embodiment of suitcase provided by the invention.

Please refer to FIG. 26, a suitcase which provides in this example of execution, unlike the NO. 1 example of execution, the shape of the operation component 1 and the setting position are different, specifically, the operating component 1 is recessed to the right side of the front surface of the suitcase, and the operation component 1 is a strip shape. The operating component 1 opens a locking component which is matched with the operating component 1 by toggling. The remaining technical features are the same as the NO. 1 example of execution, and the description will not be repeated here.

In addition to the above examples of execution, the operating component of the lock of the suitcase may be provided in any other suitable shape, and may be provided in any suitable position of the suitcase body, and the mentioned here is non-mandatory limitation.

The optimized examples of execution of this invention disclosed above are only used for the statement of this invention. The optimized examples of execution do not give a detailed statement of all the details, and such examples of execution shall not limit this invention to be merely in the specific mode of execution as stated above. Evidently, it is suitable to make plenty of modifications and changes based on the contents of the instructions. The purpose for the instructions to select and describe those examples of execution specifically is to explain the principle and practical application of this invention in a better way, and to enable the technical personnel in the technical field to comprehend and utilize this invention in a better way. This invention shall be subject to the Claims and its full extent and any equivalent.

The invention claimed is:

1. A lock set on a suitcase of being opened or closed without using a zipper, comprising:

an operating component and a locking component, wherein the operating component and the locking component are mounted separately in the suitcase; wherein, the operating component is set on a non-border position of the suitcase, and the locking component is set on the border of the suitcase; the locking component comprises at least one locking unit, a force transfer between the operating component and the locking component is provided by a force transmission mechanism which is connected between the operating component and the locking component; the operating component comprises an operation member, and the locking unit comprises a lock head and a lock hook, wherein driving the operation member can drive the lock head or the lock hook to move through the force transmission mechanism, to lock or unlock the lock, wherein: the force transmission mechanism adopts a wire-drawing mechanism or a rope-pulling mechanism.

2. The lock set of claim 1, wherein the operating component further comprises a lock body mechanism, wherein the lock body mechanism comprises a lock body and a rotating component or a moving component that set in the lock body; both the operation member and the force transmission mechanism are connected to the rotating component or the moving component, wherein the operation member drives the rotating component to rotate or drives the moving component to move, and the rotating component rotates or the moving component moves to drive the lock head or the lock hook to move through the force transmission mechanism.

3. The lock set of claim 2, wherein: the operating component further includes an open-close locking mechanism for controlling the movement or locking of the rotating component or the moving component.

4. The lock set of claim 2, wherein: the rotating component is a rotating shaft, wherein the operation member and the force transmission mechanism are both connected with the rotating shaft, and the operation member drives the rotating shaft to rotate, while the rotating shaft rotates to drive the lock head and the lock hook to move relatively through the force transmission mechanism;

the moving component includes a cover plate, a movable block that arranged on the cover plate, a locking block which is connected with the movable block through a eccentric column, wherein the operation member is connected with the locking block and drives the locking block to rotate, and the locking block drives the movable block to move through the eccentric column, and the movable block drives the lock head and the lock hook to move relatively through the force transmission mechanism.

5. The lock set of claim 1, wherein: the lock head is installed on the border of a cover of the suitcase case through a lock bracket, and the force transmission mechanism drives the lock head to move along the lock bracket; the lock hook is installed on the border of the other cover of the suitcase and opposite to the lock head, wherein the lock head can move along the lock bracket to realize buckling or separating between the lock head and the lock hook.

6. The lock set of claim 1, wherein: the locking component comprises two locking units, and the lock heads of the two locking units are connected to the force transmission mechanism in series, wherein the movement directions of the lock heads of the two locking units are consistent, and the hook parts of the lock hooks of the two locking units toward the same direction.

7. The lock set of claim 1, wherein: the locking component comprises a first locking unit and a second locking unit, wherein the first locking unit comprises a first lock head and a first lock hook, and the second locking unit comprises a second lock head and a second lock hook;

wherein, the force transmission mechanism drives the first lock head to move, and the second lock head is connected to the first lock head through a steering mechanism, wherein the direction of movement of the first lock head and the second lock head is opposite to each other, and the hook parts of the first lock hook and the second lock hook toward opposite direction.

8. The lock set of claim 7, wherein: the steering mechanism comprises a rotary table, a first connecting rod and a second connecting rod, wherein the first lock head is connected to the rotary table through the first connecting rod; one end of the second connecting rod is connected to the rotary table, and the other end of the second connecting rod is connected to the second lock head; the first connecting rod is parallel to the second connecting rod; when the first lock head moves towards one direction and separates itself from the first lock hook, the first connecting rod drives the rotary table to rotate, and the rotary table rotates to drive the second connecting rod to move towards the opposite direction, and the second connecting rod drives the second lock head to move towards the opposite direction to achieve separation between the second lock head and the second lock hook.

9. The lock set of claim 1, wherein: the operating component further includes a self-locking mechanism for self lock of the operation member.

10. A lock set on a suitcase of being opened or closed without using a zipper, comprising:

a lock body, a toggle, a locking rope, a rotating shaft, a lock head and a lock hook, wherein, the rotating shaft is set in the lock body, and the side of the rotating shaft is connected respectively with the two ends of the rope, and two connecting parts between the rotary shaft and the locking rope are located in the same radial direction position of the rotating shaft; the toggle is connected to the rotating shaft, and drives the rotating shaft to rotate; the locking rope is connected with the lock head, and a fastening surface of the lock head and the lock hook is parallel to the locking rope.

11. The lock set of claim 10, wherein: two parallel guiding grooves are set along the circumferential direction of the rotary shaft, and the two ends of the locking rope are respectively set in the two guiding grooves, and the guiding groove guides the locking rope.

12. The lock set of claim 10, wherein: the lock further includes a self-locking mechanism which is used for locking the toggle and the lock body.

13. The lock set of claim 10, wherein the lock body, a handle and the rotating shaft are installed at the upper corner of the front surface of the suitcase in a sunken way, and the rotating surface of the toggle is perpendicular to the plane where the lock hook and lock head is located.

14. The lock set of claim 10, wherein: the toggle has a limiting structure that is used for defining a maximum rotation angle of the toggle as 120 degree.

15. The lock set of claim 10, wherein: external of the locking rope is further sleeved with a sheath.

16. A lock set on a suitcase of being opened or closed without using a zipper, comprising:

a cover, and a bottom shell, wherein, the cover and the bottom shell are fixedly connected, and the cover and the bottom shell butt joint to form an accommodating space, wherein the accommodating space is provided with a cover plate, a locking plate movably connected with the cover plate, a wire-drawing mechanism and an open-close locking mechanism for driving the movement of the locking plate, wherein the locking plate includes a first hook part, a moving part and a connecting part, and the moving part is located between the first hook part and the connecting part, and the first hook part of the locking plate are fixedly connected with the open-close locking mechanism, while the connecting part of the locking plate is fixedly connected with the wire-drawing mechanism; the wire-drawing mechanism comprises a movable block that movably connected with the cover plate, and the bottom of the movable block is provided with a first clamping slot, and the first clamping slot is internally provided with a steel wire; the lock set further comprises at least one locking unit for controlling the opening and closing of the suitcase, and the wire-drawing mechanism is driven-connected to a locking component through the steel wire.

17. The lock set of claim 16, wherein: a chute for moving the movable block is formed in the cover plate.

18. The lock set of claim 16, wherein: the lock further comprises a locking block located in the accommodating space and a handle located outside the accommodating space, wherein a first eccentric column is set at the bottom of the locking block, and a first clamping groove clamped with the first eccentric column is formed in the top of the movable block; the locking block is further provided with a second clamping groove which is clamped with the connecting part of the locking plate;

a first positioning column is set at the bottom of the handle, and a positioning hole is formed in the top of the locking block, wherein the first positioning column penetrates through the cover and fixedly connected with the positioning hole; wherein, rotating the handle drives the locking block to rotate, and the rotation of the locking block drives the movable block to move through the first eccentric column.

19. The lock set of claim 18, wherein: a self-locking mechanism is set between the handle and the cover plate, wherein the self-locking mechanism comprises a pushing block and a top block set perpendicularly to each other; the pushing block comprises a push button part and an abutting part; the top block comprises a protruding part and a first fixed part; wherein, a first accommodating groove is formed in the bottom of the handle, wherein the abutting part and the protruding part are all located in the first accommodating groove, and the abutting part abuts against the protruding part;

a second positioning column is set on the first positioning column, and a third positioning column is set on the cover plate, wherein the third positioning column is positioned right below the second positioning column, and a spring is sleeved between the second positioning column and the third positioning column.

20. The lock set of claim 18, wherein: the open-close locking mechanism comprises a lock core, a lock core sleeve that sleeved on the lock core, and a rotating block that set at the bottom of the lock core sleeve;

the cover plate is provided with a second accommodating groove for accommodating the rotating block, and a positioning groove is set at the bottom of the lock core, and a fourth positioning column fixedly connected with the positioning slot is set on the top of the rotating block; a second eccentric column is set at the bottom of the rotating block, wherein the second eccentric column is clamped with the first hook part of the locking plate.

21. The lock set of claim 16, wherein: the locking component includes:

a lock bracket, set on the suitcase, and a accommodating groove is formed in the lock bracket;

a lock head, set in the accommodating groove and can move along the accommodating groove; a second hook part is set on one side of the lock head, and a second clamping slot used for arranging the steel wire is set on the other side of the lock head;

a lock hook, comprising a third hook part clamped of the second hook part, and a second fixed part used for fixing the lock hook to the suitcase.

22. A suitcase, wherein a connecting part of the suitcase is provided with a border, and the suitcase is provided with a lock, wherein the lock comprises an operating component and a locking component, wherein the operating component and the locking component are connected and transmit the force through a force transmission mechanism, wherein the locking component is provided inside the suitcase border, and the operating component is concavely formed in the outer surface of the suitcase except the border of the suitcase, wherein: the force transmission mechanism adopts a wire-drawing mechanism or a rope-pulling mechanism.

23. The suitcase of claim 22, wherein: the operating component is set on one of the front side, the right side and the upper surface of the suitcase; or, the operating component is set at an edge or a middle portion of a surface of the suitcase.

24. The suitcase of claim 22, wherein: a lock core is further integrated on the operating component.

25. The suitcase of claim 22, wherein: the operating component is a spring-loaded structure.

* * * * *